US006991422B2

(12) United States Patent
Spatafora et al.

(10) Patent No.: US 6,991,422 B2
(45) Date of Patent: Jan. 31, 2006

(54) METHOD AND UNIT FOR TRANSFERRING BLANKS

(75) Inventors: Mario Spatafora, Bologna (IT); Franco Carini, Granarolo Emilia (IT)

(73) Assignee: G.D. Societa' per Azioni, Bologna (IT)

( * ) Notice: Subject to any disclaimer, the term of this patent is extended or adjusted under 35 U.S.C. 154(b) by 226 days.

(21) Appl. No.: 10/022,817

(22) Filed: Dec. 18, 2001

(65) Prior Publication Data

US 2002/0090290 A1 Jul. 11, 2002

(30) Foreign Application Priority Data

Dec. 22, 2000 (IT) ..... BO2000A0740

(51) Int. Cl.
*B65G 57/00* (2006.01)

(52) U.S. Cl. ..... 414/791; 414/416.05; 53/458

(58) Field of Classification Search ..... 414/796, 414/796.4, 796.7, 796.9, 789.9, 790.2, 796.6, 414/790.7, 403, 791, 789.2, 416.05, 416.06, 414/802, 811, 788.4, 788.6; 53/458, 447, 53/475

See application file for complete search history.

(56) References Cited

U.S. PATENT DOCUMENTS 4,907,941 A 3/1990 Focke et al. ..... 414/795.8
4,911,608 A * 3/1990 Krappitz et al. ..... 414/796
5,074,745 A * 12/1991 Neri ..... 414/796.9
5,183,380 A 2/1993 Focke et al. ..... 414/795.8
5,336,040 A * 8/1994 Focke et al. ..... 198/750.11
5,340,263 A * 8/1994 Neri et al. ..... 414/412
5,411,362 A * 5/1995 Neri et al. ..... 414/796.9
5,417,543 A * 5/1995 Focke et al. ..... 414/796.9
5,426,921 A * 6/1995 Beckmann ..... 53/566
5,533,854 A * 7/1996 Focke et al. ..... 414/412
5,582,504 A * 12/1996 Cestonaro ..... 414/796.9
5,970,834 A * 10/1999 Garofano et al. ..... 83/90
6,155,775 A * 12/2000 Depinet et al. ..... 414/796.4
6,238,173 B1 * 5/2001 Corsini ..... 414/788.1
6,546,698 B1 * 4/2003 Focke et al. ..... 53/447

* cited by examiner

*Primary Examiner*—Richard Ridley
(74) *Attorney, Agent, or Firm*—Ladas & Parry LLP

(57) ABSTRACT

A method and unit for transferring blanks on a packing machine, whereby stacks of blanks are transferred from a platform, on which the blanks are arranged in stacks, to a store wherein the blanks are packed successively and seamlessly along a path for supply to a pickup station of the packing machine; transfer of the stacks from the platform to the store including forming, at a loading station and by means of two gripping devices for gripping the stacks, a group of blanks defined by stacks superimposed and aligned in a container, feeding the container and the group along a path to an unloading station at the store, and transferring the group of blanks from the container to the store.

55 Claims, 6 Drawing Sheets

METHOD AND UNIT FOR TRANSFERRING BLANKS

The present invention relates to a method of transferring blanks.

More specifically, the present invention relates to a method of transferring blanks on an automatic packing machine for producing rigid packets of cigarettes, to which the following description refers purely by way of example.

BACKGROUND OF THE INVENTION

To produce rigid packets of cigarettes, cardboard blanks must be fed to a pickup station of the packing machine so that each blank is withdrawn individually and folded about a group of cigarettes to form a packet of cigarettes.

The blanks are flat pieces of cardboard cut and notched beforehand to form fold lines, and are supplied in packages comprising a pallet on which the blanks are arranged for optimum transport and packing.

The blanks in each package are divided into side by side stacks to form layers, which in turn are stacked on the pallet and separated from one another by separators. The cigarette packing machine comprises a blank store for supplying the pickup station, where each blank is withdrawn individually by a gripping member and transferred to folding stations on the packing machine. In the store, the blanks are arranged in a seamless succession, and are packed and aligned with one another so as to be picked up by the gripping member in a given position and with a given orientation.

Given the increasingly fast output rate of automatic packing machines, all the blanks in the package must be transferred rapidly to the store to replace the empty pallet with a new package and, at the same time, arrange the blanks in the required orderly succession in the store.

Current transfer methods fail to provide for transferring and simultaneously arranging the blanks in the required orderly succession in the store, in such a manner as to meet the requirements of modern automatic packing machines.

U.S. Pat. No. 5,183,380 discloses a feeding apparatus for automatically transferring stacks of blanks from a pallet to a blank magazine of a high performance packaging machine. The feeding apparatus comprises an endless pocket conveyor between a feed station and the blank magazine; each pocket of the pocket conveyor receives a relevant blank stack in the feed station, transports the blank stack along a feeding path to the supply magazine, in which the stack is automatically pushed out of the conveyor pocket into the blank magazine. The feeding apparatus disclosed by U.S. Pat. No. 5,183,380 has a relatively high fast output rate; however, such feeding apparatus is cumbersome, complicated and expensive.

SUMMARY OF THE INVENTION

It is an object of the present invention to provide a method of transferring blanks, designed to eliminate the drawbacks of known methods.

According to the present invention, there is provided a method of transferring blanks, on a packing machine, from a platform supporting a number of blanks divided into stacks, to a store where the blanks are packed successively and seamlessly along a first supply path of a pickup station of the packing machine; the method being characterized by forming, at a loading station and by means of at least one gripping device, a group of blanks defined by at least two stacks superimposed and aligned in a container; feeding the container along a second path to an unloading station at the store; and transferring the group of blanks from the container to the store.

The above method provides for packing the stacks of blanks at the loading station and then transferring a group of packed blanks directly to the store.

Separating pickup of the blanks and transfer of the group provides for selecting, on the one hand, the most suitable gripping device for picking up the stacks on the platform, and, on the other, the most suitable container for forming the group and transferring the group to the store. Moreover, the container so accumulates the blanks as to enable supply of the platform.

The present invention also relates to a unit for transferring blanks.

According to the present invention, there is provided a transfer unit for transferring blanks on a packing machine comprising a blank store; the transfer unit comprising a platform for supporting a number of blanks divided into stacks, and at least one transfer device for transferring said stacks of blanks from the platform to the store, wherein the blanks are packed successively and seamlessly and aligned along a first supply path of a pickup station of the packing machine; and the transfer unit being characterized by comprising a container for housing a group of blanks defined by at least two aligned and superimposed stacks, and which is movable along a second path between a loading station at said gripping device and an unloading station at said store.

The present invention also relates to a packing machine store designed to cooperate with the transfer unit according to the present invention.

According to the present invention, there is provided a blank store forming part of a machine and cooperating with a transfer unit for transferring blanks; characterized by comprising a push device having a supporting wall perpendicular to a first path and movable along said first path to support the blanks in said store.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
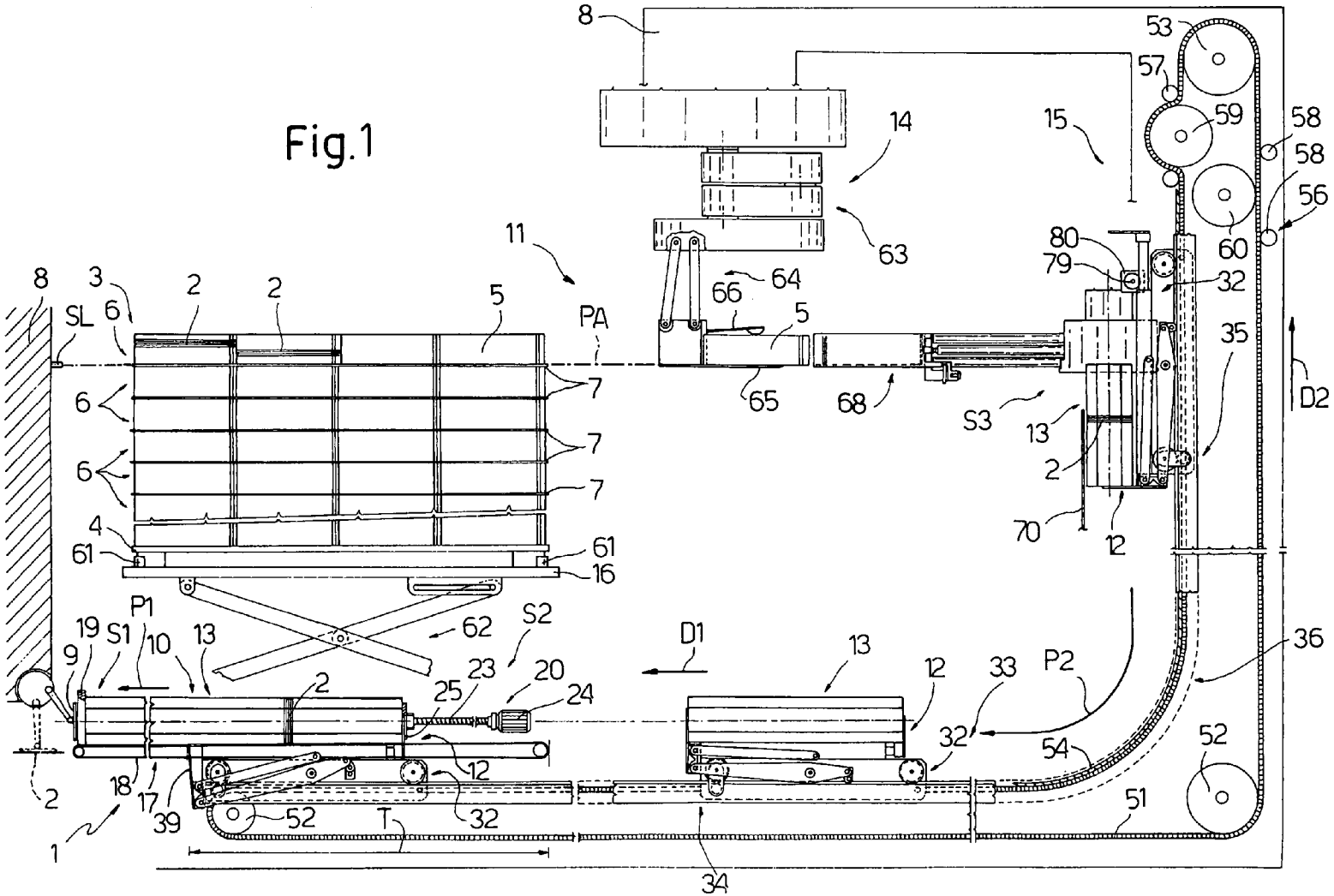
FIG. 1 shows a schematic side view, with parts removed for clarity, of a packing machine with a transfer unit, and which shows a carriage-mounted container in various work positions separated by break lines.

With reference to FIG. 1, number 1 indicates as a whole a packing machine for producing rigid packets of cigarettes (not shown), each comprising a rigid cardboard blank 2 folded about a group of cigarettes (not shown). Blanks 2 are flat pieces of cardboard cut and notched beforehand to form fold lines (not shown), and are supplied in packages 3, one of which is shown in FIG. 1 and comprises a pallet 4 on which blanks 2 are arranged in orderly fashion.

That is, blanks 2 are arranged in side by side stacks 5 to form layers 6, which in turn are stacked on pallet 4 and separated from one another by separators 7. Stacks 5 rest on separators 7 or, in the case of the bottom layer 6, directly on pallet 4, and are unbound, i.e. have no bands or other wrappers, to simplify supply of blanks 2 to machine 1; and each blank 2 extends parallel to a horizontal plane perpendicular to the FIG. 1 plane.

Machine 1 comprises a frame 8 supporting a gripping member 9 for withdrawing one blank 2 at a time; a store 10 for storing blanks 2 and feeding blanks 2 along a path P1 to gripping member 9; and a transfer unit 11 for transferring stacks 5 of blanks from pallet 4 to store 10.

Transfer unit 11 comprises a container 12 movable along a given path P2 to transfer groups 13 of stacks 5; two gripping devices 14 and 15 for transferring stacks 5 of blanks; and a locating platform 16 for setting pallet 4 in a given position with respect to gripping device 14.

Gripping member 9 comprises a suction-type gripping head for withdrawing a blank 2 extending parallel to a vertical plane at a pickup station S1, and for feeding blank 2 to folding stations (not shown) of machine 1.

Store 10 comprises a conveyor 17 supporting a number of blanks 2 arranged in orderly fashion to assist withdrawal of each blank 2 by gripping member 9. In the orderly arrangement in store 10, blanks 2 are arranged successively, are packed and aligned with one another, extend parallel to said vertical plane, and rest on edge on conveyor 17, which extends a given length in a horizontal direction D1 from pickup station S1 to form a stock of blanks 2 for supply to pickup station S1.

Conveyor 17 comprises two spaced, parallel belts 18 looped about pulleys and which support blanks 2 resting on edge on the conveying branches of belts 18. Store 10 comprises an output gate 19; and a push device 20 for keeping blanks 2 in store 10 in the on-edge position. Gate 19 comprises a central opening (not shown), is located at pickup station S1, and provides for supporting the succession of blanks 2 and, at the same time, enabling gripping member 9 to penetrate output gate 19 to withdraw the blank 2 contacting gate 19.

Figure 2:
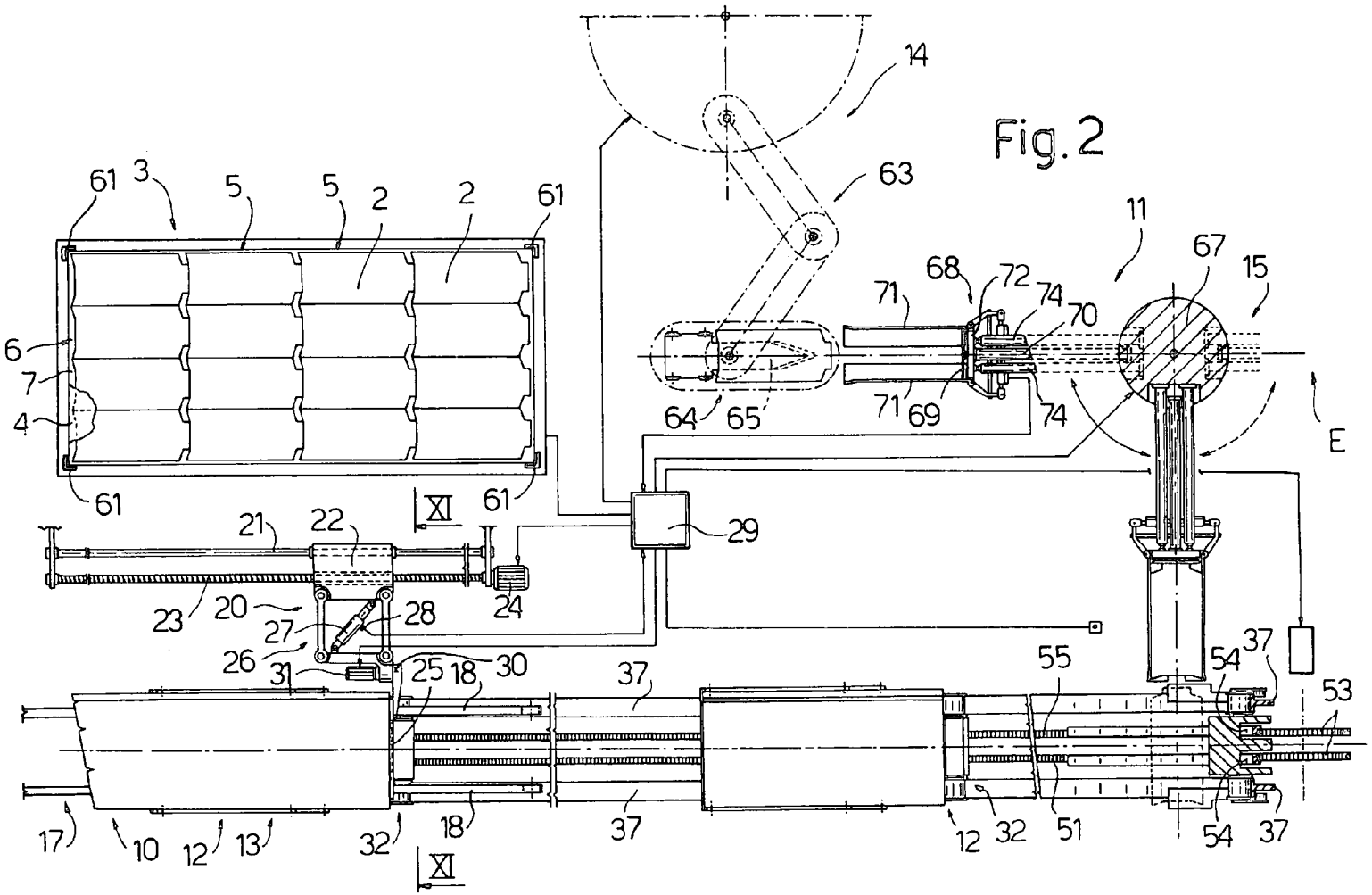
FIG. 2 shows a schematic plan view of various component parts of the FIG. 1 machine.

As shown clearly in FIG. 2, push device 20 provides for supporting the succession of blanks 2 on the opposite side to gate 19, and for accompanying blanks 2 as they travel towards gate 19. That is, gate 19 and push device 20 directly support the end blanks 2 in the succession of blanks 2 in store 10, and indirectly support the blanks 2 between the two end blanks 2.

Push device 20 comprises a sleeve 22, which is movable in direction D1 along a guide 21 parallel to conveyor 17, and is connected to a worm 23 activated by a motor 24. Push device 20 also comprises a supporting wall 25 perpendicular to direction D1 and connected to sleeve 22 by an articulated quadrilateral 26, which comprises a spring 27 extending between two opposite articulations of quadrilateral 26, and a sensor 28 for detecting deformation of spring 27. Sensor 28 is connected to a control unit 29 for operating motor 24, which sets sleeve 22, and therefore wall 25, to such a position as produce constant deformation of spring 27. That is, the position of wall 25 is determined by feedback control as a function of the expansion or contraction of spring 27 with respect to a set deformation value corresponding to a given pressure exerted by wall 25 on blanks 2 in store 10.

Figure 11:
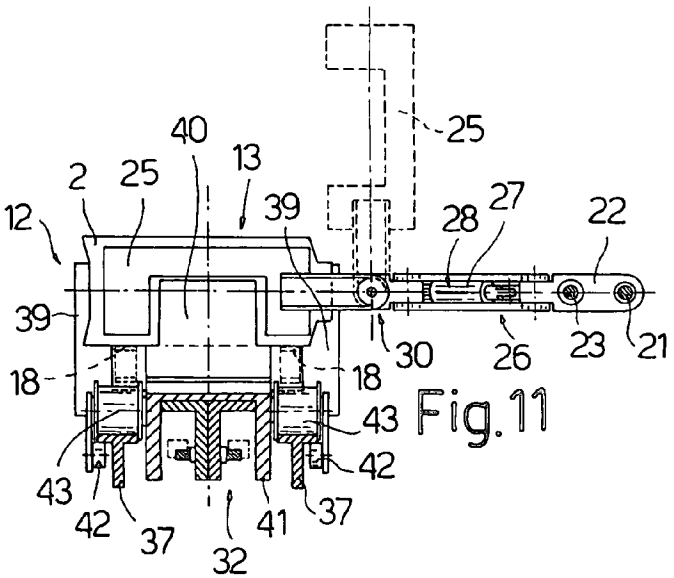
FIG. 11 shows a section of FIG. 2 along line XI— XI.

Wall 25 is connected to articulated quadrilateral 26 by means of a hinge 30, which has an axis parallel to direction D1 and is controlled by an actuator 31 to move wall 25 between a work position (shown by the continuous line in FIG. 11) in which wall 25 is located along path P1, and a rest position (shown by the dash line in FIG. 11) in which wall 25 is located to the side of path P1.

Figure 16:
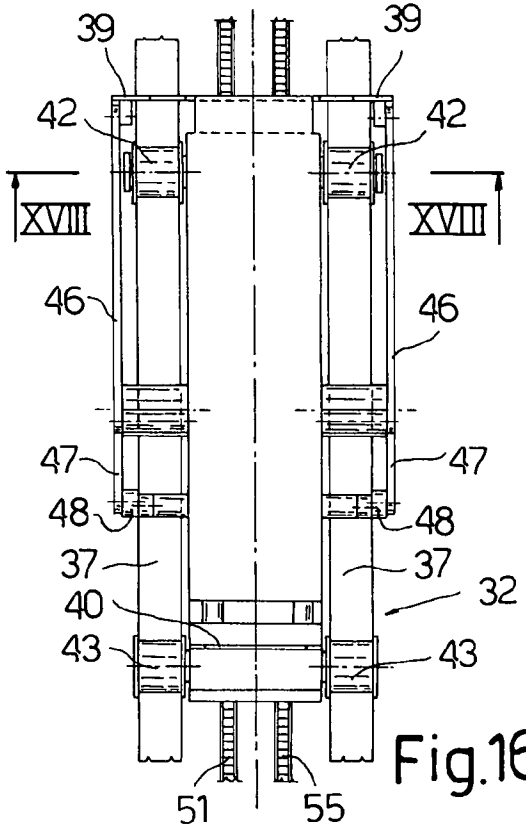
FIG. 16 shows a plan view, with parts removed for clarity, of a portion of the FIG. 1 machine.
Figure 18:
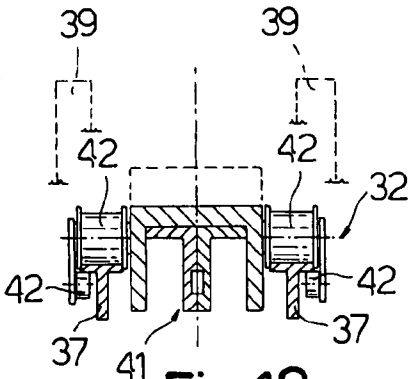
FIG. 18 shows a section, with parts removed for clarity, of the FIG. 16 machine portion along line XVIII—XVIII.
Figure 17:
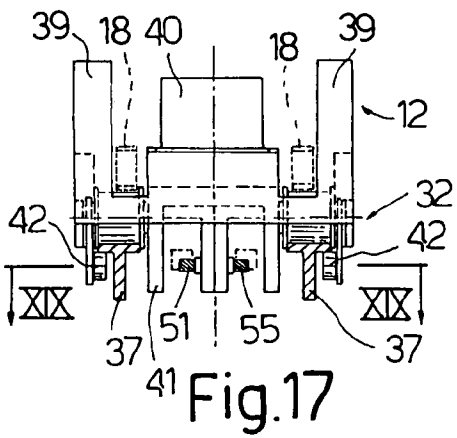
FIG. 17 shows a front view, with parts in section and parts removed for clarity, of the FIG. 16 machine portion.

With reference to FIG. 1, container 12 is mounted on a carriage 32 movable along a guide 33, which is integral with frame 8 and comprises a straight portion 34 parallel to direction D1 and extending partly beneath conveyor 17, a straight portion 35 parallel to a vertical direction D2, and a curved portion 36 connecting the two straight portions 34 and 35. Guide 33 is defined by two parallel rails 37, each having an outer rolling track and an inner rolling track, as shown in FIGS. 16 and 17. Guide 33 defines path P2, which comprises a straight portion parallel to direction D1, and a straight portion parallel to direction D2; and paths P1 and P2 are superimposed along a portion T substantially defining an unloading station S2, as described later on.

Figure 3:
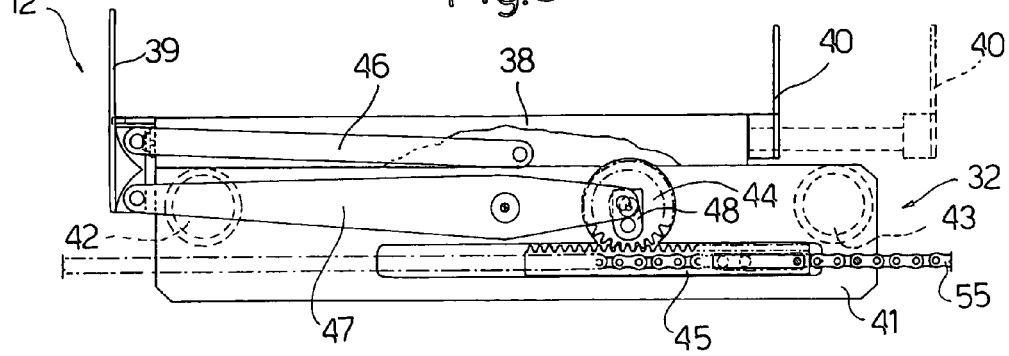
FIGS. 3 and 4 show larger-scale side views, with parts removed for clarity, of the FIG. 1 carriage in two different work positions.
Figure 4:
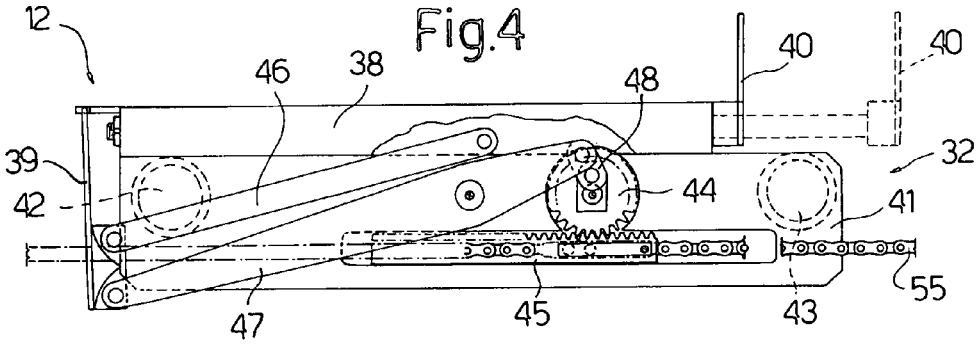

With reference to FIGS. 3 and 4, container 12 comprises a bottom wall 38, a front wall 39, and a rear wall 40. Bottom wall 38 is integral with carriage 32, which comprises a frame 41; front wheels 42 arranged in pairs (FIGS. 1, 16, 17, 18) to grip the outer tracks and inner tracks of rails 37; and rear wheels 43 resting on the outer tracks of rails 37 (FIG. 1).

With reference to FIGS. 3 and 4, front wall 39 is perpendicular to bottom wall 38 and is movable between the FIG. 3 position and the FIG. 4 position by means of a mechanism comprising an articulated quadrilateral, and a gear 44 and rack 45 coupling for adjusting the position of the articulated quadrilateral. The articulated quadrilateral is defined by wall 39, by frame 41, and by two levers 46 and 47; and gear 44 is connected to lever 47 by a connecting rod 48 to rotate lever 47 and set wall 39 to the FIG. 3 or FIG. 4 position.

Figure 19:
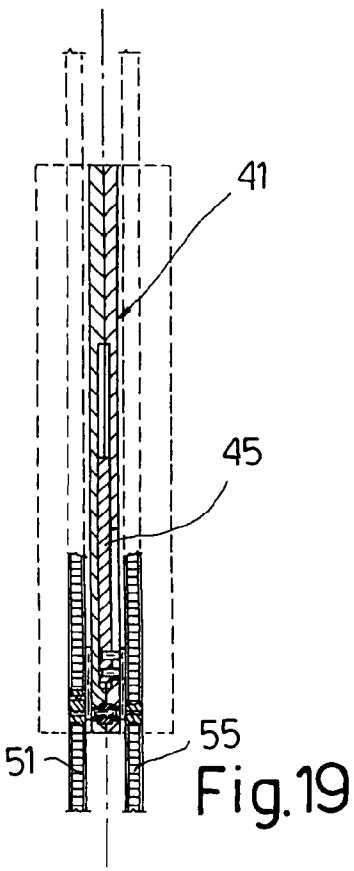
FIG. 19 shows a section, with parts removed for clarity, of the FIG. 17 machine portion along line XIX—XIX.

As shown in FIG. 19, rack 45 is housed in a seat on frame 41 of carriage 32, and is movable, with respect to frame 41, parallel to path P2 of carriage 32.

Figure 5:
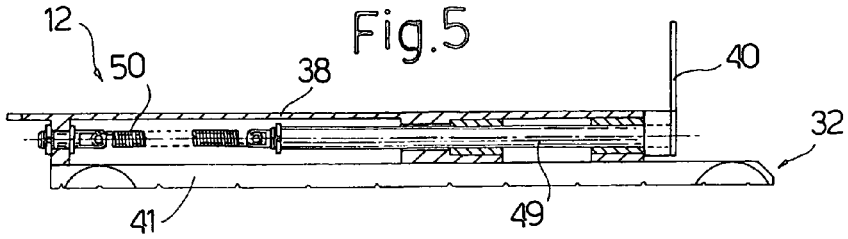
FIGS. 5 and 6 show side views, with parts in section and parts removed for clarity, of a detail of the FIG. 3 carriage in two different work positions.
Figure 6:
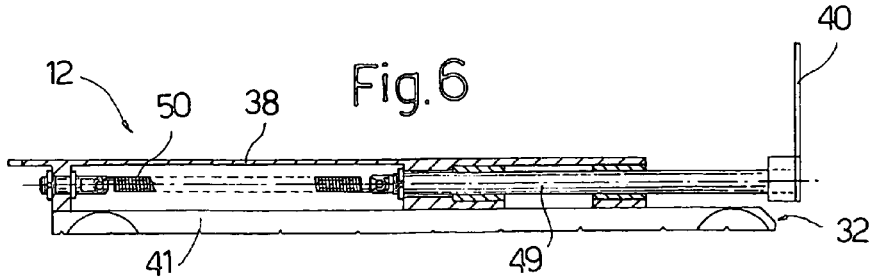

With reference to FIGS. 5 and 6, rear wall 40 is perpendicular to bottom wall 38 and is fitted to an arm 49 connected in sliding manner to frame 41 and movable between the FIG. 5 position and the FIG. 6 position. The end of arm 49 opposite the end connected to wall 40 is anchored to frame 41 by a spring 50.

With reference to FIG. 1, carriage 32 is moved along path P2 by a chain 51, which is looped about two transmission pulleys 52 and a drive pulley 53, and comprises a work branch parallel to guide 33. At curved portion 36 of guide 33, chain 51 is guided by a curved track 54.

Carriage 32 is connected to chain 51, as shown clearly in FIG. 19, and is positioned by chain 51 at unloading station S2 (FIG. 1) at store 10, and at a loading station S3 (FIG. 1) along the straight vertical portion 35 of guide 33. Machine 1 comprises a further chain 55, which is parallel to chain 51, is looped about two transmission pulleys (not shown) coaxial with transmission pulleys 52, and about a drive pulley (not shown) coaxial and integral with pulley 53, and is guided by curved track 54. Unlike chain 51, chain 55 is anchored, not to carriage 32, but to rack 45 (FIG. 19), which slides with respect to frame 41 of carriage 32 to activate front wall 39. Chain 55 is connected to a shift device 56 for varying the position of chain 55 with respect to chain 51.

Figure 13:
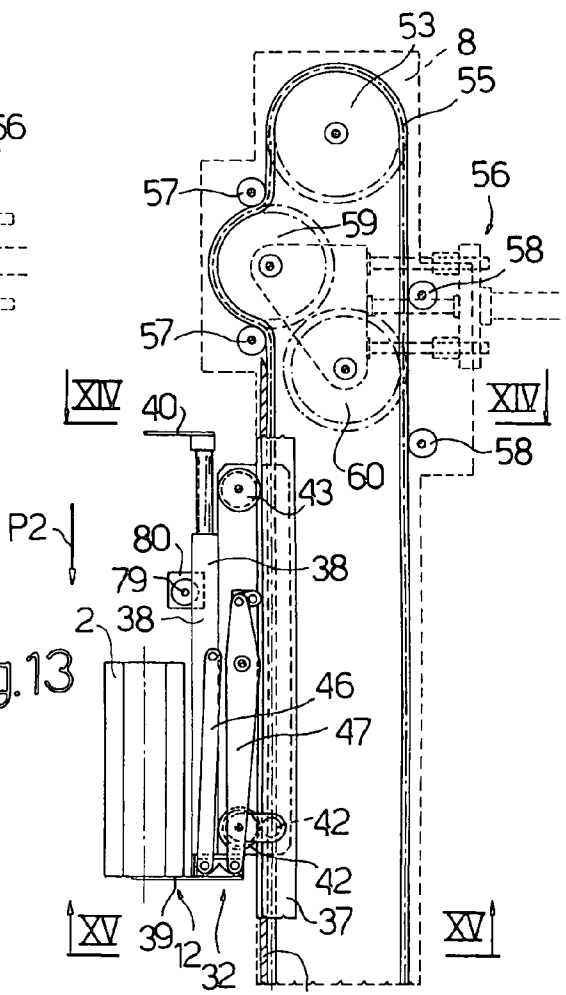
FIG. 13 shows a larger-scale side view, with parts removed for clarity, of a device on the FIG. 1 machine.
Figure 12:
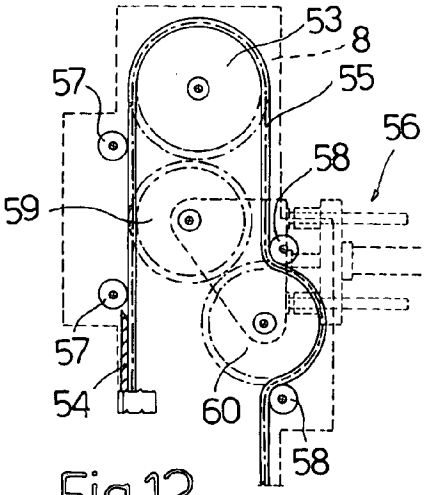
FIG. 12 shows a larger-scale side view, with parts removed for clarity, of a device on the FIG. 1 machine.
Figure 15:
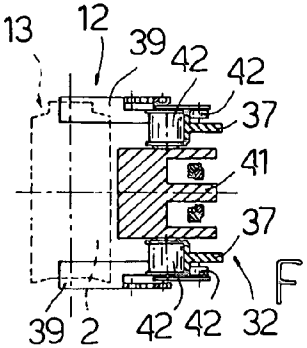
FIG. 15 shows a section of FIG. 13 along line XV—XV.

As shown clearly in FIGS. 12 and 13, shift device 56 comprises two rollers 57 located outside the loop formed by chain 55 and along the work branch of chain 55; two rollers 58 located outside the loop formed by chain 55 and along the return branch of chain 55; and two movable rollers 59 and 60 activated by an actuator (not shown) and located inside the loop formed by chain 55. Rollers 59 and 60 can be positioned selectively between rollers 57 and 58 respectively, to vary the length of the portions of chain 55 along the work and return branches of chain 55, and so move rack 45 with respect to carriage 32, and wall 39 between the work positions shown in FIGS. 3 and 4.

With reference to FIG. 2, platform 16 has locators 61 for positioning pallet 4 with respect to platform 16, and is movable in direction D2 by means of a lifting device 62 shown schematically in FIG. 1.

With reference to FIG. 1, frame 8 supports gripping device 14 at platform 16, and gripping device 15 at loading station S3 for loading container 12. Device 14 comprises an articulated arm 63 pivoting about vertical axes; and a gripper 64 in turn comprising a blade 65 and a jaw 66 located over blade 65, which is movable substantially in a horizontal plane PA indicated by the dot-and-dash line in FIG. 1, and is inserted between a separator 7 and the bottom blank 2 in each stack 5.

Once blade 65 is inserted beneath a stack 5, jaw 66 is closed onto the stack 5 to withdraw it from package 3 and transfer it to gripping device 15. Gripping device 14 provides for adjusting the position of gripper 64 with respect to plane PA in direction D2, but has substantially no movement in direction D2.

Figure 7:
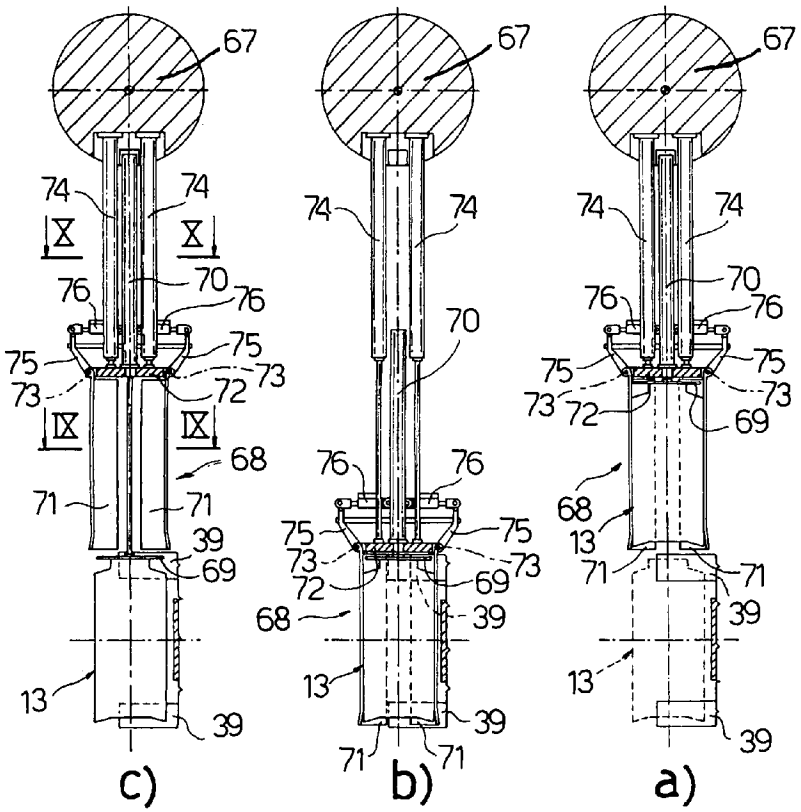
FIGS. 7*a*, 7*b*, 7*c* show plan views, with parts in section and parts removed for clarity, of a FIG. 1 machine device in different operating positions.

With reference to FIG. 2, gripping device 15 comprises a shaft 67 rotating about a vertical axis, and a transfer member 68 fitted to shaft 67. Like gripping device 14, transfer member 68 of gripping device 15 has substantially no movement in direction D2. As shown clearly in FIGS. 7*a* to 7*c*, transfer member 68 comprises an end wall 69 fitted to telescopic arms 70 extending radially with respect to shaft 67; and two lateral walls 71, which are connected by a plate 72, pivot with respect to plate 72 about respective vertical axes 73, and are fitted to telescopic arms 74 parallel to telescopic arms 70 and for moving lateral walls 71 with respect to end wall 69.

Figure 8:
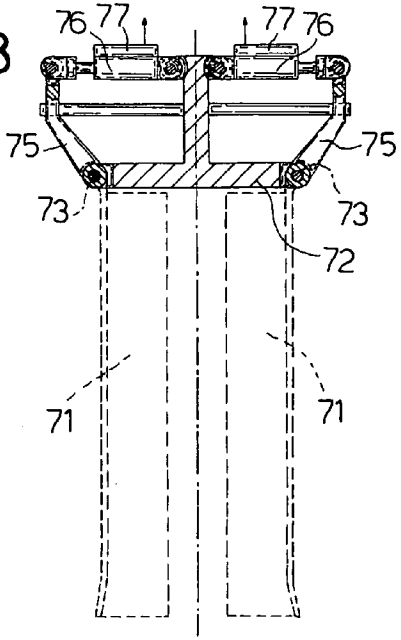
FIG. 8 shows a larger-scale plan view, with parts in section and parts removed for clarity, of a detail of the FIG. 7*c* device.
Figure 9:
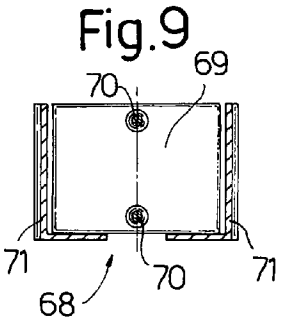
FIG. 9 shows a section along line IX—IX of the FIG. 7*c* device.
Figure 10:
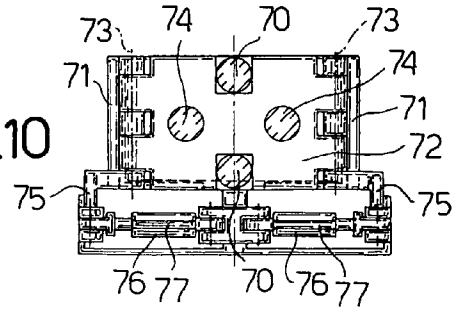
FIG. 10 shows a section of FIG. 7*c* along line X—X.

With reference to FIGS. 8, 9 and 10, each lateral wall 71 is L-shaped to define a bottom portion for supporting each stack 5, and is connected to an arm 75. Each arm 75 has one end integral with lateral wall 71 and rotating about axis 73, and one end connected to a spring 76 located between arm 75 and plate 72. Spring 76 is equipped with a sensor 77 for detecting deformation of spring 76 and so determining the angular position of respective wall 71; and sensor 77 is connected to control unit 29, which determines deformation of springs 76 and accordingly controls displacement of gripping device 15.

Figure 14:
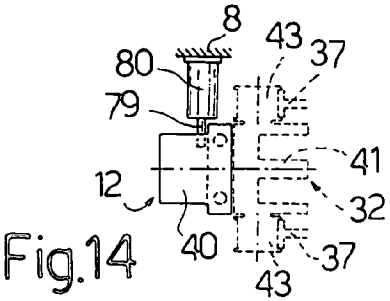
FIG. 14 shows a section of FIG. 13 along line XIV—XIV.

With reference to FIG. 1, transfer unit 11 also comprises a guide wall opposite the vertical portion of path P2; a stop member 79 controlled by an actuator 80 and movable between a rest position and a work position intercepting wall 40 of container 12 as shown in FIG. 14; and a sensor SL for detecting the level of the top layer 6 of a package 3 on platform 16.

In actual use, store 10 and transfer unit 11 are controlled by control unit 29 shown schematically in FIG. 2.

A package 3 of blanks is placed on platform 16 in the position defined by locators 61, and lifting device 62 positions package 3 so that the top separator 7 coincides with plane PA, which is determined by the position of sensor SL, and the top layer 6 of package 3 ideally rests on plane PA. Gripping device 14 takes one stack 5 at a time off the top layer 6 by means of gripper 64, and transfers each stack 5 to gripping device 15. When the whole layer 6 has been removed from package 3 by gripping device 14, separator 7 is removed and platform 16 is raised to move the next separator up to plane PA and sensor SL.

With reference to FIG. 2, gripping device 15 rotates shaft 67 about its vertical axis to set transfer member 68 selectively to a receiving position shown partly by the dash line in FIG. 2, to a transfer position shown by the continuous line in FIG. 2, and to a reject position indicated as a whole by E. In the receiving position, gripper 64 inserts a stack 5 between walls 71 and onto end wall 69 of transfer member 68.

The respective bottom portions of L-shaped lateral walls 71 provide for supporting stack 5, are coincident with plane PA, and are spaced apart; and, when transferring stack 5 from gripper 64 to transfer member 68, blade 65 is inserted between the bottom portions of lateral walls 71.

In the event stack 5 or even only one of blanks 2 in stack 5 is not aligned with gripper 64, lateral walls 71 flex by being mounted elastically. When gripper 64 releases stack 5, lateral walls 71 exert pressure on the misaligned stack 5 or blank 2 to position stack 5 correctly inside transfer member 68 and align any misaligned blanks 2 with the other blanks 2 in stack 5 by means of springs 76, which position walls 71 parallel and aligned with each other.

In the event walls 71 fail, under the action of springs 76, to position stack 5 or blanks 2 correctly with respect to transfer member 68, sensors 77 detect persistent deformation of springs 76 with respect to an optimum or threshold value, and control unit 29 sets transfer member 68 to reject position E to expel stack 5 by extending arms 70 to move end wall 69 forward.

Conversely, if the signal received by control unit 29 indicates no persistent deformation of springs 76 with respect to the optimum or threshold value, transfer member 68 is moved into the transfer position to transfer stack 5 to container 12. In other words, lateral walls 71 define a reference system for the blanks in each stack 5 transferred to transfer member 68, and at the same time provide for correcting the position of the blanks with respect to lateral walls 71 themselves.

Container 12 is moved into loading station S3 by means of carriage 32 activated by chain 51 and drive pulley 53. At loading station S3, bottom wall 38 of the carriage is perpendicular to direction D1; walls 39 and 40 are perpendicular to direction D2; and the empty container 12 is positioned so that wall 39 is practically coincident with plane PA. At this stage, and with reference to FIGS. 7*a* to 7*c*, gripping device 15 places a stack 5 on wall 39 by means of transfer member 68, which, by simultaneously extending arms 70 and 74, is moved from the transfer position (FIG. 7*c*) into the FIG. 7*b* position in which the bottom portions of lateral walls 71 substantially contact wall 39. Lateral walls 71 are then withdrawn by means of arms 74, while end wall 69 remains fixed. Following this operation, by which a stack 5 now rests on wall 39, carriage 32 is lowered one step equal to the height of each stack 5 to place the next stack 5 on top of stack 5.

Stacks 5 are placed one on top of the other inside container 12 until the top stack 5 nears wall 40. As container 12 is lowered one step further, wall 40 contacts stop member 79, which, in the meantime, has been set to the work position by actuator 80 and, at each step of carriage 32, moves wall 40 away from wall 39 and the superimposed stacks 5 to enable further stacks 5 to be placed one on top of the other to form a group 13 of blanks comprising a given N number of superimposed, aligned stacks 5.

In other words, at each step of carriage 32, carriage 32 positions container 12 at loading station S3 so that a supporting surface of container 12 is perpendicular to direction D2 and substantially aligned with plane PA. The supporting surface is defined by front wall 39 when container 12 is empty, and by the top blank 2 in container 12 when container 12 is partly filled.

The blanks 2 resting on the platform and on carriage 32 at loading station S3 extend perpendicularly to direction D2, while the blanks 2 housed in store 10 and container 12 at unloading station S2 extend perpendicularly to direction D1.

Once group 13 of blanks is completed, actuator 80 resets stop member 79 to the rest position, and wall 40 is positioned contacting the top blank 2 in group 13 by means of spring 50 (FIGS. 5 and 6), so as to grip group 13 between walls 39 and 40 and prevent any movement of blanks 2 as they are transferred along path P2 from loading station S3 to unloading station S2.

Carriage 32 and container 12 are fed along path P2 and oriented so that bottom wall 38 of container 12 is parallel to direction D1, and blanks 2 are parallel to the blanks 2 in store 10, i.e. perpendicular to direction D1. Group 13 of blanks is transferred from container 12 to conveyor 17 along portion T.

Frame 41 of carriage 32 is so formed as to penetrate between belts 18 of conveyor 17 and superimpose paths P1 and P2. Carriage 32 is arrested upon container 12 contacting wall 25, which is moved by container 12 in direction D1. The movement of wall 25 is detected by sensor 28, which detects deformation of quadrilateral 26 and spring 27. As a result, control unit 29 successively stops chain 51, rotates wall 25 about hinge 30 into the rest position, and moves wall 25 in direction D1 into a position aligned with rear wall 40 of container 12. Wall 25 is then moved back into the work position shown by the continuous line in FIG. 11, and is moved up to group 13 without interfering with wall 40, by virtue of the complementary shape of walls 25 and 40.

As wall 25 is performing the above movements, wall 39 is lowered into the FIG. 4 position as described previously, and carriage 32 and container 12 are sent back to loading station S3 to receive another group 13 of blanks. On the way from unloading station S2 to loading station S3, wall 39 is restored to the FIG. 3 position as described previously. With wall 25 positioned downstream from group 13, the transfer of container 12 from unloading station S2 to loading station S3 transfers group 13 of blanks from wall 38 of container 12 onto belts 18 of conveyor 17, so that group 13 is packed directly with the blanks 2 already in store 10.

A layer 6 of stacks is defined by an M number of side by side stacks, while each group is defined by an N number of superimposed stacks; and the relation between M and N may conveniently be selected so that M is a whole multiple of N, and so that a separator 7 can be removed and an empty pallet 4 replaced with a new package 3 as carriage 32 travels both ways between loading station S3 and unloading station S2.

What is claimed is:

1. A method of transferring blanks, on a packing machine, from a platform (16) supporting a number of blanks (2) divided into stacks (5), to a store (10) where the blanks (2) are packed successively and seamlessly along a first supply path (P1) of a pickup station (Si) of the packing machine; the method comprising the steps of forming, at a loading station (S3) and by means of at least one gripping device (14, 15), a group (13) of blanks defined byat least two stacks (5) superimposed and aligned in a container (12);

feeding the container (12) along a second path (P2) to an unloading station (S2) at the store (10);

transferring said group (13) of blanks all together from the container (12) to the store (10); and guiding the travel of said container (12) to alter the orientation of the container (12) and of the group (13) of blanks during transfer along said second path (P2); wherein the blanks (2) in said store (10) and in said container (12) at the unloading station (S2) extend perpendicularly to a first direction (D1), and the blanks (2) on said platform (16) and in said container (12) at the loading station (S3) extend perpendicularly to a second direction (D2) crosswise to the first direction (D1).

2. A method as claimed in claim 1 wherein the container (12) is fed along said second path (P2) along a first portion parallel to the first direction (D1), and along a second portion parallel to said second direction (D2).

3. A method as claimed in claim 2, wherein the container (12) is fed from said loading station (S3) located along said second portion, to said unloading station (S2) located along said first portion.

4. A method as claimed in claim 3, wherein the container (12) is fed along a portion (T) of said second path (P2), which overlaps with said first path (P1) parallel to said first direction (D1) and faces said unloading station (S2).

5. A method as claimed in claim 1, comprising determining the position of the blanks (2) in each stack (5) with respect to a reference system by a transfer member (68) of the gripping device (15) as said transfer member (68) is transferred from the platform (16) to said loading station (S3).

6. A method as claimed in claim 5, comprising locating the reference system on said transfer member (68) by walls (71).

7. A method as claimed in claim 5, comprising aligning any misaligned blank (2) in said stacks (5) by said transfer member (68).

8. A method as claimed in claim 5, comprising rejecting blanks (2) not aligned in said stacks (5) by said gripping device (15).

9. A method as claimed in claim 1, comprising finding the blanks (2) in said store (10) along said first path (P1), and supporting said blanks (2) by a supporting wall (25) parallel to said blanks (2) and movable along the first path (P1).

10. A method as claimed in claim 9, wherein said blanks (2) are fed by a conveyor (17); said supporting wall (25) being activated by an actuator (24) controlled independently by the conveyor (17).

11. A method as claimed in claim 9, comprising activating said supporting wall (25) by an actuator (24) as a function of pressure between the supporting wall (25) and the blanks (2) in the store (10).

12. A method as claimed in claim 1, comprising moving a supporting wall (25) from a work position in which the supporting wall (25) is located along the first path (P1), to a rest position in which said supporting wall (25) is located alongside said first path (P1).

13. A method as claimed in claim 12, comprising setting said supporting wall (25) to the rest position when said group (13) of blanks is fed into the unloading station (S2) and exerts a given pressure on said supporting wall (25).

14. A method as claimed in claim 13, comprising moving the supporting wall (25) in the first direction (D1) upstream from the group (13) of blanks, while maintaining said supporting wall (25) in the rest position; the supporting wall (25) being moved into the work position; and the supporting wall is brought into contact with the group (13) of blanks.

15. A method as claimed in claim 1, comprising transferring each stack (5) from said platform (16) to said container (12) along a plane (PA) and without changing the level of the stack (5).

16. A method as claimed in claim 15, wherein the stacks (5) on said platform (16) are arranged side by side to form superimposed layers (6); the method further comprising moving said platform (16) vertically so that, each time, the top layer (6) lies in said plane (PA).

17. A method as claimed in claim 15, comprising moving said container (12) so that a surface supporting the stacks (5) in said container (12) lies in said plane (PA).

18. A method as claimed in claim 17, comprising supporting the stacks (5 by a wall (39) of said container (12) or by the top blank (2) in the top stack (5) housed in the container (12).

19. A method as claimed in claim 15, comprising moving a transfer member (68) of said gripping device (15) along said plane (PA).

20. A method as claimed in claim 1, wherein transfer from said platform (16) to said container (12) comprises picking up each stack (5) by means of a gripper (64) of a first gripping device (14), and transferring said stack (5) from said gripper (64) to a transfer member (68) of a second gripping device (15); said gripper (64) picking up the stacks (5) off said platform (16); and said transfer member (68) placing the stacks (5) inside said container (12).

21. A method as claimed in claim 1, comprising arranging the stacks (5) of blanks on said platform (16) side by side to form layers (6); each layer (6) being defined by an M number of stacks (5) of blanks; said group (13) being defined by anN number of stacks (5) of blanks; and the M number being a whole multiple of N.

22. A method as claimed in claim 1, wherein a transfer unit (11) is formed by the platform (16) for supporting a number of blanks (2) divided into stacks (5), and at least one transfer device (14, 15) for transferring said stacks (5) of blanks from the platform (16) to the store (10), wherein the blanks (2) are packed successively and seamlessly and aligned along the first supplypath (P1) of the pickup station (S1) of the packing machine (1); the transfer unit (11) also comprising the container (12) for housing the group of blanks (2) defined by at least two aligned and superimposed stacks (5), and which is movable along the second path (P2) between the loading station (S3) at said gripping device (14, 15) and the unloading station (S2) at said store (10).

23. A method as claimed in claim 22, wherein the blanks (2) in said store (10) and in said container (12) at the unloading station (S2) extend perpendicularly to a first direction (D1), and the blanks (2) on said platform (16) and in said container (12) at the loading station (S3) extend perpendicularly to a second direction (D2) crosswise to the first direction (D1); the transfer unit (11) having a guide (33) parallel to the second path (P2) for guiding said container (12) and altering the orientation of the container (12) and the group (13) of blanks during transfer along said second path (P2).

24. A method as claimed in claim 23, comprising forming said guide (33) with a first portion (34) parallel to the first direction (D1), a second portion (35) parallel to said second direction (D2), and a curved portion (36) connecting the first and second portions (34, 35).

25. A method as claimed in claim 24, comprising locating said loading station (S3) along the second portion (35) of the guide, and said unloading station (S2) along said first portion (34) of the guide.

26. A method as claimed in claim 25, comprising overlapping the first and second path (P1, P2) along a portion (T) parallel to the first direction (D1); said unloading station (S2) being located along said portion (T); said first path (P1) being defined by a conveyor (17) with belts (18); and said container (12) being mounted on a carriage (32) insertable between the belts (18) along said portion (T).

27. A method as claimed in claim 22, comprising feeding said stacks (5) of blanks to said container (12) by a transfer member (68) of the gripping device (15).

28. A method as claimed in claim 27, comprising providing a further gripping device (14) for transferring said stacks (5) of blanks from said platform (16) to the gripping device (15); said further gripping device (14) comprising a gripper (64) for inserting a stack (5) of blanks into said transfer member (68).

29. A method as claimed in claim 27, comprising providing said transfer member (68) with a reference system and control members (76, 77) for determining the position of the blanks (2) in each stack (5) in said transfer member (68).

30. A method as claimed in claim 29, comprising providing said reference system with two lateral walls (71) maintained parallel to each other by said control members (76, 77), which comprise elastic means (76), and sensors (77) for detecting deformation of the elastic means (76).

31. A method as claimed in claim 30, wherein, under the action of said elastic means (76), said lateral walls (71) exert a compression force on the stack (5) of blanks positioned incorrectly in said transfer member (68); said compression force aligning the stack (5) or the blanks (2) with respect to the reference system.

32. A method as claimed in claim 30, comprising providing movement of said gripping device (15) between a receiving position, a transfer position to transfer the stack (5) of blanks to said container (12), and a reject position (B) to reject the stacks (5) of blanks not aligned to the reference system or containing blanks (2) not aligned to the reference system.

33. A method as claimed in claim 28, providing said gripping device (15) and said further gripping device (14) with respective means (76, 63) for moving said transfer member (68) and said gripper (64) along a plane (PA).

34. A method as claimed in claim 33, comprising arranging the stacks (5) on said platform (16) side by side to form superimposed layers (6); and providing said platform (16) with a lifting device (62) for moving said platform (16) vertically, and with a level sensor (SL) for positioning the top layer (6), each time, in said plane (PA).

35. A method as claimed in claim 33, comprising positioning said container (12) along said guide (33), and for so positioning the container (12) at the loading station (S3) as to define a surface for supporting the stacks (5) in said container (12) and lying in said plane (PA).

36. A method as claimed in claim 35, comprising providing said container (12) with a first wall (39); said surface for supporting the stacks (5) being defined by said first wall (39) when said container (12) is empty; and said surface for supporting the stacks being defined by the top blank (2) in said container (12) when the container (12) is partly filled.

37. A method as claimed in claim 22, comprising providing the store with a push device (20) having a supporting wall (25) perpendicular to said first path (P1) and movable along said first path (P1) to support the blanks (2) in said store (10).

38. A method as claimed in claim 37, comprising positioning said blanks (2) in a conveyor on edge; the and feeding said supporting wall (25) along the first path (P1) independently of said conveyor (17).

39. A method as claimed in claim 38, comprising providing said push device (20) with detecting means (26, 27, 28) for detecting pressure exerted on said supporting wall (25) in said first direction (D1); and controlling said supporting wall as a function of said pressure.

40. A method as claimed claim 37, comprising providing said push device (20) with a further actuator (31) for rotating the supporting wall (25) between a work position in which the supporting wall (25) is located along said first path (P 1), and a rest position in which said supporting wall (25) is located alongside said first path (P1).

41. A method of transferring blanks, on a packing machine, from a platform (16) supporting a number of blanks (2) divided into stacks (5), to a store (10) where the blanks (2) are packed successively and seamlessly along a first supply path (P1) of a pickup station (S1) of the packing machine; the method comprising the step of forming, at a loading station (S3) and by means of at least one gripping device (14, 15), a group (13) of blanks defined by at least two stacks (5) superimposed and aligned in a container (12); feeding the container (12) along a second path (P2) to an unloading station (S2) at the store (10);

transferring said group (13) of blanks all together from the container (12) to the store (10);

determining the position of the blanks (2) in each stack (5) with respect to a reference system by a transfer member (68) of the gripping device (15) as said transfer member (68) is transferred from the platform (16) to said loading station (S 3); and locating the reference system on said transfer member (68) by walls (71).

42. A method as claimed in claim 41, comprising aligning any misaligned blanks (2) in said stacks (5) by said transfer member (68).

43. A method as claimed in claim 41, comprising rejecting blanks (2) not aligned in said stacks (5) by said gripping device (15).

44. A method of transferring blanks, on a packing machine, from a platform (16) supporting a number of blanks (2) divided into stacks (5), to a store (10) where the blanks (2) are packed successively and seamlessly along a first supply path (P1) of a pickup station (S1) of the packing machine; the method comprising the step of forming, at a loading station (S3) and by means of at least one gripping device (14, 15), a group (13) of blanks defined by at least two stacks (5) superimposed and aligned in a container (12);

feeding the container (12) along a second path (P2) to an unloading station (S2) at the store (10);

transferring said group (13) of blanks all together from the container (12) to the store (10); and finding the blanks (2) in said store (10) along said first path (P1), and supporting said blanks (2) by a supporting wall (25) parallel to said blanks (2) and movable along the first path (P1).

45. A method as claimed in claim 44, wherein said blanks (2) are fed by a conveyor (17); said supporting wall (25) being activated by an actuator (24) controlled independently by the conveyor (17).

46. A method as claimed in claim 44, comprising activating said supporting wall (25) by an actuator (24) as a function of pressure between the supporting wall (25) and the blanks (2) in the store (10).

47. A method of transferring blanks, on a packing machine, from a platform (16) supporting a number of blanks (2) divided into stacks (5), to a store (10) where the blanks (2) are packed successively and seamlessly along a first supply path (P1) of a pickup station (S1) of the packing machine; the method comprising the step of forming, at a loading station (S3) and by means of at least one gripping device (14, 15), a group (13) of blanks defined by at least two stacks (5) superimposed and aligned in a container (12);

feeding the container (12) along a second path (P2) to an unloading station (S2) at the store (10);

transferring said group (13) of blanks all together from the container (12) to the store (10); and moving a supporting wall (25) from a work position in which the supporting wall (25) is located along the first path (P1), to a rest position in which said supporting wall (25) is located alongside said first path (P1).

48. A method as claimed in claim 47, comprising setting said supporting wall (25) to the rest position when said group (13) of blanks is fed into the unloading station (S2) and exerts a given pressure on said supporting wall (25).

49. A method as claimed in claim 48, comprising moving the supporting wall (25) in the first direction (D1) upstream from the group (13) of blanks, while maintaining said supporting wall (25) in the rest position; the supporting wall (25) being moved into the work position; and the supporting wall is brought into contact with the group (13) of blanks.

50. A method of transferring blanks, on a packing machine, from a platform (16) supporting a number of blanks (2) divided into stacks (5), to a store (10) where the blanks (2) are packed successively and seamlessly along a first supply path (P1) of a pickup station (S1) of the packing machine; the method comprising the step of forming, at a loading station (S3) and by means of at least one gripping device (14, 15), a group (13) of blanks defined byat least two stacks (5) superimposed and aligned in a container (12);

feeding the container (12) along a second path (P2) to an unloading station (S2) at the store (10);

transferring said group (13) of blanks all together from the container (12) to the store (10); and transferring each stack (5) from said platform (16) to said container (12) along a plane (PA) and without changing the level of the stack (5).

51. A method as claimed in claim 50, wherein the stacks (5) on said platform (16) are arranged side by side to form superimposed layers (6); the method further comprising moving said platform (16) vertically so that, each time, the top layer (6) lies in said plane (PA).

52. A method as claimed in claim 50, comprising moving said container (12) so that a surface supporting the stacks (5) in said container (12) lies in said plane (PA).

53. A method as claimed in claim 52, comprising supporting the stacks (5 by a wall (39) of said container (12) or by the top blank (2) in the top stack (5) housed in the container (12).

54. A method as claimed in claim 50, comprising moving a transfer member (68) of said gripping device (15) along said plane (PA).

55. A method of transferring blanks, on a packing machine, from a platform (16) supporting a number of blanks (2) divided into stacks (5), to a store (10) where the blanks (2) are packed successively and seamlessly along a first supply path (P1) of a pickup station (S1) of the packing machine; the method comprising the step of forming, at a loading station (S3) and by means of at least one gripping device (14, 15), a group (13) of blanks defined by at least two stacks (5) superimposed and aligned in a container (12);

feeding the container (12) along a second path (P2) to an unloading station (52) at the store (10); and transferring said group (13) of blanks all together from the container (12) to the store (10);

wherein transfer from said platform (16) to said container (12) comprises picking up each stack (5) by means of a gripper (64) of a first gripping device (14), and transferring said stack (5) from said gripper (64) to a transfer member (68) of a second gripping device (15); said gripper (64) picking up the stacks (5) off said platform (16); and said transfer member (68) placing the stacks (5) inside said container (12).

* * * * *

UNITED STATES PATENT AND TRADEMARK OFFICE

CERTIFICATE OF CORRECTION

PATENT NO. : 6,991,422 B2
APPLICATION NO. : 10/022817
DATED : January 31, 2006
INVENTOR(S) : Mario Spatafora et al.

It is certified that error appears in the above-identified patent and that said Letters Patent is hereby corrected as shown below:

On title page, item 73, "D." should read -- D --.

Signed and Sealed this

Eleventh Day of July, 2006

JON W. DUDAS
*Director of the United States Patent and Trademark Office*